US005241298A

United States Patent [19]

Lian et al.

[11] Patent Number: 5,241,298

[45] Date of Patent: Aug. 31, 1993

[54] ELECTRICALLY-AND-MAGNETICALLY-COUPLED, BATTERYLESS, PORTABLE, FREQUENCY DIVIDER

[75] Inventors: Ming R. Lian, Clearwater; Fred W. Herman, Tampa, both of Fla.

[73] Assignee: Security Tag Systems, Inc., St. Petersburg, Fla.

[21] Appl. No.: 853,533

[22] Filed: Mar. 18, 1992

[51] Int. Cl.[5] ..... G08B 13/24

[52] U.S. Cl. ..... 340/572; 307/219.1; 363/157; 363/159

[58] Field of Search ..... 340/572; 307/219.1; 363/157, 159

[56] References Cited

U.S. PATENT DOCUMENTS

| | | | |
|---|---|---|---|
| 3,906,245 | 9/1975 | Shen | 307/320 |
| 4,314,373 | 2/1982 | Sellers | 455/73 |
| 4,481,428 | 11/1984 | Charlot | 307/219.1 |
| 4,670,740 | 6/1987 | Herman et al. | 340/572 |
| 5,065,137 | 11/1991 | Herman | 340/572 |
| 5,065,138 | 11/1991 | Lian et al. | 340/572 |

*Primary Examiner*—Glen R. Swann, III
*Attorney, Agent, or Firm*—Edward W. Callan

[57] ABSTRACT

A batteryless, portable, frequency divider includes a first resonant circuit that is resonant at a first frequency for receiving electromagnetic radiation at the first frequency; and a second resonant circuit that is resonant at a second frequency that is one-half the first frequency for transmitting electromagnetic radiation at the second frequency; and a circuit element electrically connecting the first resonant circuit to the second resonant circuit. The first resonant circuit is coupled magnetically to the second resonant circuit to transfer energy to the second resonant circuit at the first frequency in response to receipt by the first resonant circuit of electromagnetic radiation at the first frequency; and at least one of the first resonant circuit, the second resonant circuit and the circuit element includes an active element, such as a variable reactance element or a semiconductor switching device having gain, for causing the second resonant circuit to transmit electromagnetic radiation at the second frequency in response to the energy transferred from the first resonant circuit at the first frequency.

21 Claims, 4 Drawing Sheets

FIG. 1
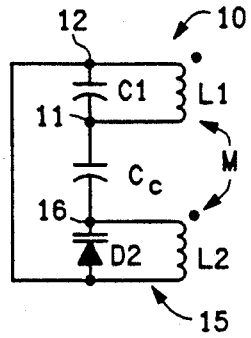
FIG. 1A
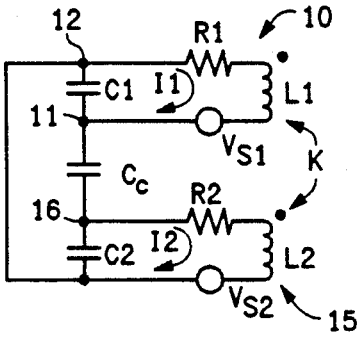
FIG. 2
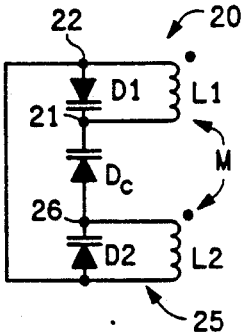
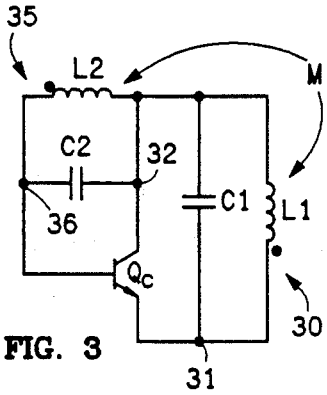
FIG. 3
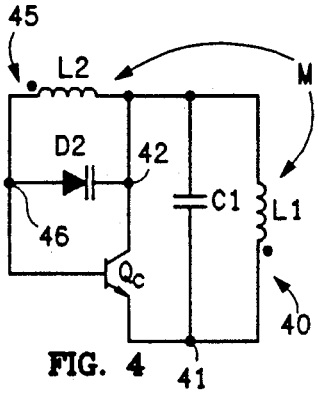
FIG. 4
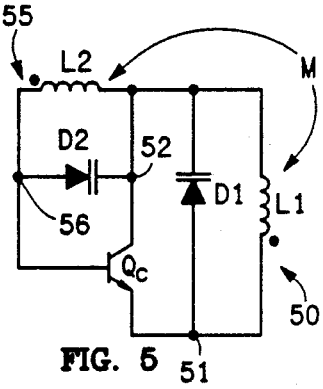
FIG. 5
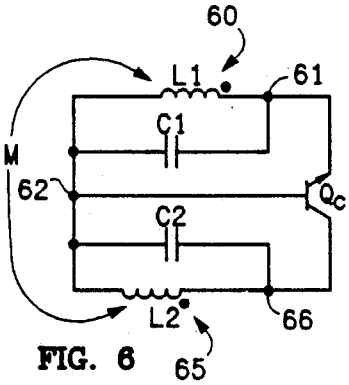
FIG. 6
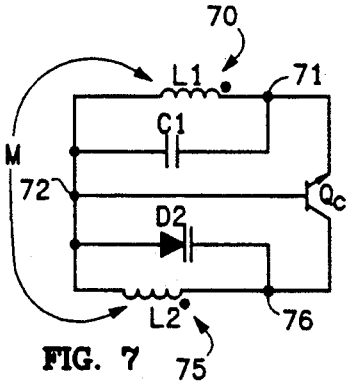
FIG. 7
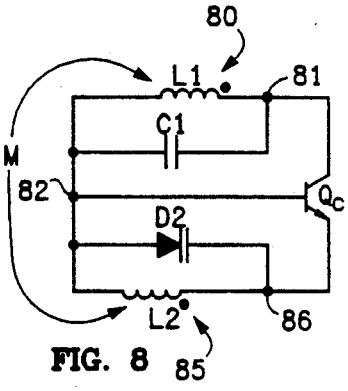
FIG. 8

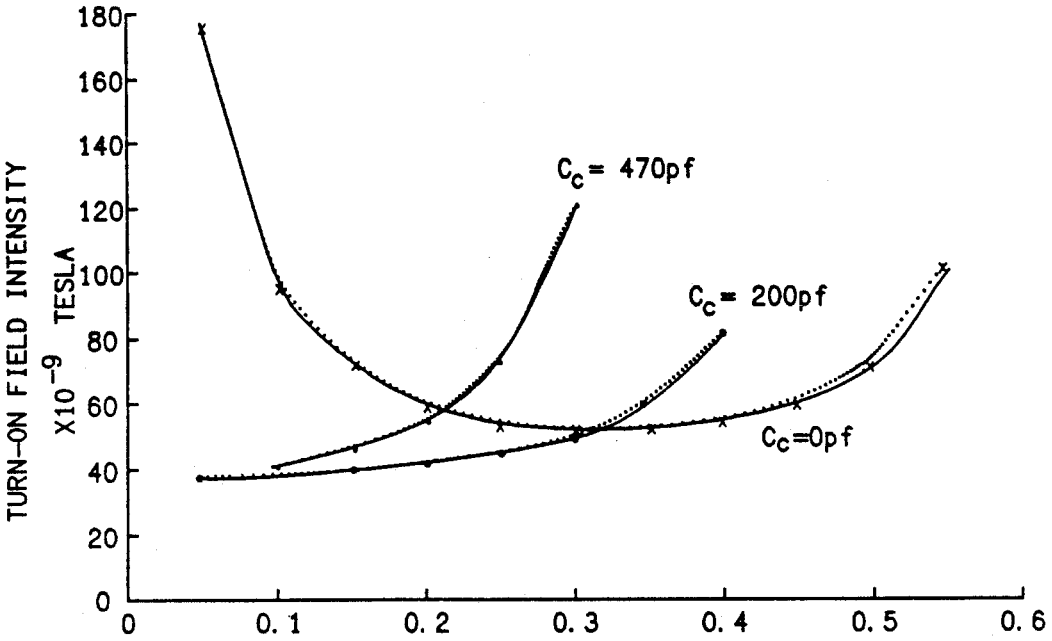
FIG. 16 K (MUTUAL COUPLING)
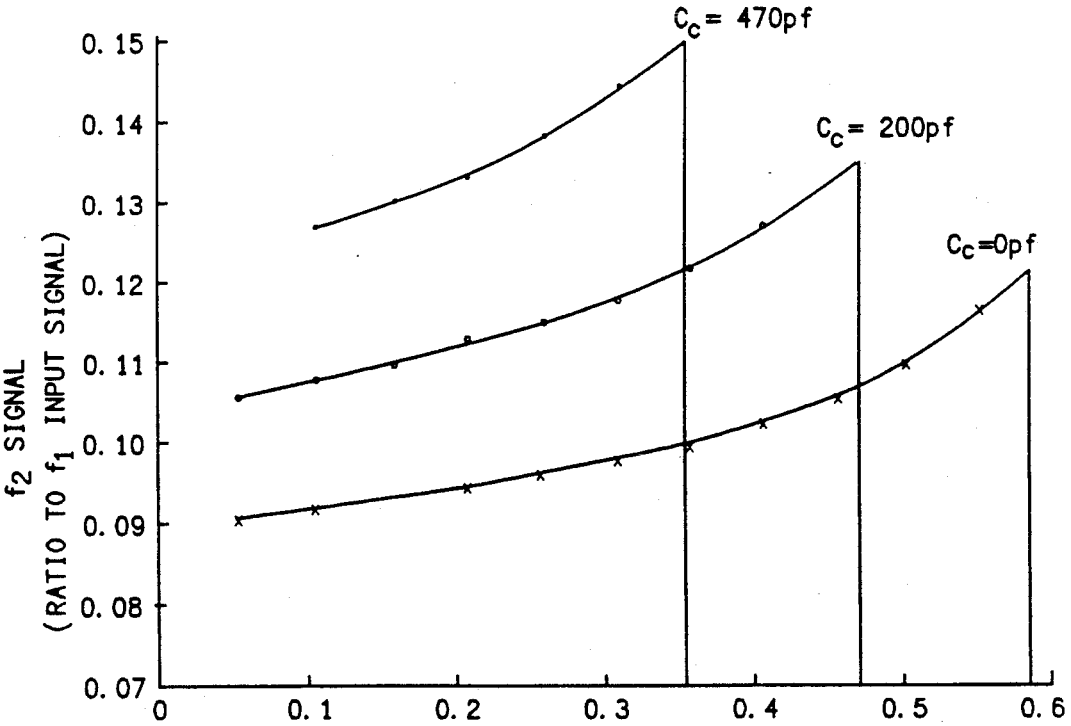
FIG. 17 K (MUTUAL COUPLING)

ELECTRICALLY-AND-MAGNETICALLY-COUPLED, BATTERYLESS, PORTABLE, FREQUENCY DIVIDER

BACKGROUND OF THE INVENTION

The present invention generally pertains to frequency dividers and is particularly directed to portable, batteryless, frequency dividers of the type that are included in tags that are used in presence detection systems.

Portable, batteryless, frequency dividers are described in U.S. Pat. No. 4,481,428 to Lincoln H. Charlot, Jr., U.S. Pat. No. 4,670,740 to Fred Wade Herman and Lincoln H. Charlot, Jr., U.S. Pat. No. 5,065,137 to Fred Wade Herman and U.S. Pat. No. 5,065,138 to Ming Lian and Fred Wade Herman.

The frequency divider described in the '428 patent includes a resonant first circuit that is resonant at a first frequency for receiving electromagnetic radiation at the first frequency, and a second resonant circuit that is resonant at a second frequency that is one-half the first frequency for transmitting electromagnetic radiation at the second frequency; and the two resonant circuits are electrically connected to one another by a semiconductor switching device having gain coupling the first and second resonant circuits for causing the second circuit to transmit electromagnetic radiation at the second frequency solely in response to unrectified energy at the first frequency provided in the first circuit upon receipt of electromagnetic radiation at the first frequency. Each resonant circuit includes a fixed capacitance connected in parallel with an inductance coil. In order to minimize difficulties due to magnetic coupling between the coils when tuning the resonant circuits to their respective resonant frequencies the coils are disposed in relation to each other so as to avoid mutual coupling. Mutual coupling is defined in the '428 patent as coupling to such an extent as to decrease the efficiency of the frequency divider. Preferably the coils are disposed perpendicular to each other so that the magnetic fields of the two coils are orthogonal to each other.

The frequency divider described in the '740 patent consists of a single resonant circuit consisting of an inductor and a variable-capacitance diode (varactor) connected in parallel to define a resonant circuit that detects electromagnetic radiation at a first predetermined frequency and responds to said detection by transmitting electromagnetic radiation at a second frequency that is one-half the first frequency, wherein the circuit is resonant at the second frequency when the voltage across the diode is zero.

The frequency divider described in the '137 and '138 patents includes a first resonant circuit that is resonant at a first frequency for receiving electromagnetic radiation at the first frequency; and a second resonant circuit that is resonant at a second frequency that is one-half the first frequency for transmitting electromagnetic radiation at the second frequency; wherein the first circuit is coupled only magnetically to the second circuit to transfer energy to the second circuit at the first frequency in response to receipt by the first circuit of electromagnetic radiation at the first frequency; and wherein the first resonant circuit and/or the second resonant circuit includes a variable reactance element in which the reactance varies with variations in energy received by and/or transferred from the first resonant circuit for causing the second resonant circuit to transmit electromagnetic radiation at the second frequency in response to the energy transferred from the first resonant circuit at the first frequency.

SUMMARY OF THE INVENTION

The present invention provides a frequency divider that utilizes both electrical and magnetic coupling between two resonant circuits.

A batteryless, portable, frequency divider according to the present invention includes a first resonant circuit that is resonant at a first frequency for receiving electromagnetic radiation at the first frequency; and a second resonant circuit that is resonant at a second frequency that is one-half the first frequency for transmitting electromagnetic radiation at the second frequency; and circuit element means electrically connecting the first resonant circuit to the second resonant circuit wherein the first resonant circuit is coupled magnetically to the second resonant circuit to transfer energy to the second resonant circuit at the first frequency in response to receipt by the first resonant circuit of electromagnetic radiation at the first frequency; and wherein at least one of the first resonant circuit, the second resonant circuit and the circuit element means includes means for causing the second resonant circuit to transmit electromagnetic radiation at the second frequency in response to the energy transferred from the first resonant circuit at the first frequency.

The transfer of energy from the first resonant circuit to the second resonant circuit is enhanced by utilizing both magnetic coupling and electrical coupling between the first resonant circuit and the second resonant circuit, whereby less field strength of electromagnetic radiation at the first frequency is necessary for accomplishing frequency division.

In a separate aspect the present invention provides a batteryless, portable, frequency divider, including a first resonant circuit that is resonant at a first frequency for receiving electromagnetic radiation at the first frequency; and a second resonant circuit that is resonant at a second frequency that is one-half the first frequency for transmitting electromagnetic radiation at the second frequency; and passive circuit element means electrically connecting the first resonant circuit to the second resonant circuit to transfer energy to the second resonant circuit at the first frequency in response to receipt by the first resonant circuit of electromagnetic radiation at the first frequency; wherein the first resonant circuit is not coupled magnetically to the second resonant circuit; and wherein at least one of the first resonant circuit and the second resonant circuit includes a variable reactance element in which the reactance varies with variations in energy received by the first resonant circuit for causing the second resonant circuit to transmit electromagnetic radiation at the second frequency in response to the energy transferred from the first resonant circuit at the first frequency.

The present invention also provides a tag including a frequency divider according to the present invention and a presence detection system including such a tag.

Additional features of the present invention are described in relation to the description of the preferred embodiments.

BRIEF DESCRIPTION OF THE DRAWING

FIG. 1 is a diagram of a preferred embodiment of a frequency divider according to the present invention.

FIG. 1A is an equivalent circuit diagram of the frequency divider of FIG. 1.

FIG. 2 is an alternative preferred embodiment of a frequency divider according to the present invention.

FIG. 3 is a diagram of another alternative preferred embodiment of a frequency divider according to the present invention.

FIG. 4 is a diagram of still another alternative preferred embodiment of a frequency divider according to the present invention.

FIG. 5 is a diagram of yet another alternative preferred embodiment of a frequency divider according to the present invention.

FIG. 6 is a diagram of a further alternative preferred embodiment of a frequency divider according to the present invention.

FIG. 7 is a diagram of still a further alternative preferred embodiment of a frequency divider according to the present invention.

FIG. 8 is a diagram of a yet further alternative preferred embodiment of a frequency divider according to the present invention.

FIG. 16 is a graph showing the variable relationship between turn-on field intensity and the mutual coupling coefficient K for the frequency divider of FIG. 1 for different exemplary values of the coupling capacitance $C_C$.

FIG. 17 is a graph showing the variable relationship between the magnitude of the electromagnetic radiation at the second frequency transmitted by the second resonant circuit of the frequency divider of FIG. 1 and the mutual coupling coefficient K for different exemplary values of the coupling capacitance $C_C$.

DESCRIPTION OF THE PREFERRED EMBODIMENTS

Figure 9:
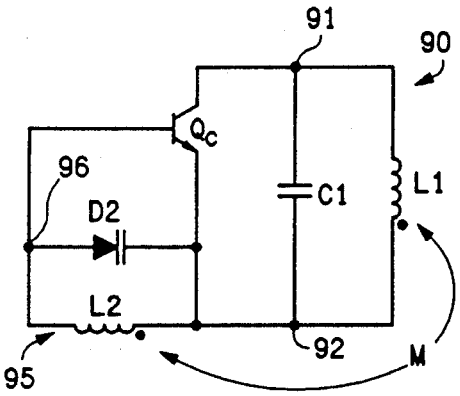
FIG. 9 is a diagram of another alternative preferred embodiment of a frequency divider according to the present invention.

Referring to FIG. 1, a preferred embodiment of a frequency divider according to the present invention includes a first resonant circuit 10 consisting of a capacitor C1 connected in parallel with an inductance coil L1 between a first node 11 and second node 12; a second resonant circuit 15 consisting of a variable capacitance diode (varactor) D2 connected in parallel with a second inductance coil L2 between the second node 12 and a third node 16; and a coupling capacitance $C_C$ connected between the first node 11 and the third node 16 to electrically connect the first resonant circuit 10 to the second resonant circuit 15. The first resonant circuit 10 is magnetically coupled to the second resonant circuit 15 by disposing the first coil L1 in a mutual inductive coupling relationship M to the second coil L2, with the two coils L1, L2 being wound respectively in an aiding direction on a ferrite rod (not shown), and with corresponding first ends of the two coils L1, L2 being connected respectively to the second node 12 and the third node 16.

The first resonant circuit 10 is resonant at a first frequency $f_1$ for receiving electromagnetic radiation at the first frequency $f_1$; and the second resonant circuit 15 is resonant at a second frequency $f_2$ that is one-half the first frequency $f_1$ for transmitting electromagnetic radiation at the second frequency $f_2$. The first circuit 10 is coupled magnetically to the second circuit 15, as described above, to transfer energy to the second circuit 15 at the first frequency $f_1$ in response to receipt by the first circuit 10 of electromagnetic radiation at the first frequency $f_1$. The varactor D2 in the second circuit 15 is a variable reactance element in which the reactance varies with variations in energy transferred from the first circuit 10 for causing the second circuit 15 to transmit electromagnetic radiation at the second frequency $f_2$ in response to the energy transferred from the first circuit 10 at the first frequency $f_1$.

Because the values of the inductances L1, L2 in each of the resonant circuits 10, 15 are affected by the respective positions of the coils L1 and L2 on the ferrite rod in relation to each other and in relation to the ends of the rod, the resonant circuits 10, 15 are tuned to their respective resonant frequencies $f_1$ and $f_2$ by adjusting the positions of the coils L1 and L2 on the rod.

In order that the coils L1 and L2 are not so highly coupled to each other that adjusting the position of a coil in one resonant circuit so greatly affects the resonant frequency of the other resonant circuit as a result of the interactive coupling between the two coils as to make tuning of both resonant circuits difficult, the coils L1, L2 are wound with an inside dimension that is somewhat larger than the cross-sectional dimension of the ferrite rod. The coils L1, L2 are wound on a nonmagnetic spacing element that is adjustably mounted on the ferrite rod. The disposition of the coils L1, L2 on the ferrite rod is described in greater detail in the aforementioned '137 patent.

It has been determined that in order to accomplish frequency division, the mutual coupling coefficient K between the inductance coil L1 of the first resonant circuit 10 and the inductance coil L2 of the second resonant circuit 15 should be within a range of zero to approximately 0.6; and that conversion of the energy of electromagnetic radiation at the first resonant frequency $f_1$ received by the first resonant circuit 10 into electromagnetic radiation radiated by the second resonant circuit 15 at the second frequency $f_2$ is most efficient when the coupling coefficient k is about 0.3.

Low-magnetic-loss ferromagnetic materials other than ferrite can be utilized in the rod on which the coils L1, L2 are wound.

In an alternative embodiment (not shown), the magnetic circuit means used to couple the coils of the different resonant circuits is merely air. This embodiment is the least complex; and adequate magnetic coupling can be attained to provide a presence detection tag that is practical for some applications by providing large coils L1, L2 that are disposed in a close overlapping proximity to one another. However, this embodiment may be more difficult to tune to the respective resonant frequencies in the absence of a ferrite core which enables fine adjustments of the resonant frequencies by adjustment of the positions of coils on the core, as discussed above.

Referring to FIG. 2, an alternative preferred embodiment of a frequency divider according to the present invention includes a first resonant circuit 20 consisting of a varactor D1 connected in parallel with an inductance coil L1 between a first node 21 and second node 22; a second resonant circuit 25 consisting of a varactor D2 connected in parallel with a second inductance coil L2 between the second node 22 and a third node 26; and a coupling varactor $D_C$ connected between the first node 21 and the third node 26 to electrically connect the first resonant circuit 20 to the second resonant circuit 25. The first resonant circuit 20 is magnetically coupled to the second resonant circuit 25 by disposing the first coil L1 in a mutual inductive coupling relationship M to the second coil L2, with the two coils L1, L2 being wound respectively in an aiding direction on a ferrite rod (not shown), and with corresponding first ends of the two coils L1, L2 being connected respectively to the second node 22 and the third node 26.

The varactor D1 in the first circuit 20 is a variable reactance element in which the reactance varies with variations in energy received by the first circuit 20 for causing the second circuit 25 to vary in reactance due to mutual reactive coupling to further cause the second resonant circuit 25 to transmit electromagnetic radiation at the second frequency $f_2$ in response to the energy transferred from the first circuit 20 at the first frequency $f_1$.

The coupling varactor $D_C$ that electrically connects the first resonant circuit 20 to the second resonant circuit 25 is a variable reactance element in which the reactance varies with variations in energy received by the first circuit 20 for causing the second circuit 25 to transmit electromagnetic radiation at the second frequency $f_2$ in response to the energy transferred from the first circuit 20 at the first frequency $f_1$.

In other respects, the frequency divider of FIG. 2 is of like construction and operates in the same manner as the frequency divider of FIG. 1.

Referring to FIG. 3, an alternative preferred embodiment of a frequency divider according to the present invention includes a first resonant circuit 30 consisting of a capacitor C1 connected in parallel with an inductance coil L1 between a first node 31 and second node 32; a second resonant circuit 35 consisting of a capacitor C2 connected in parallel with a second inductance coil L2 between the second node 32 and a third node 36; and a coupling npn transistor $Q_C$ having its emitter connected to the first node 31, its collector connected to the second node 32 and its base connected to the third node 36 to electrically connect the first resonant circuit 30 to the second resonant circuit 35. The first resonant circuit 30 is magnetically coupled to the second resonant circuit 35 by disposing the first coil L1 in a mutual inductive coupling relationship M to the second coil L2, with the two coils L1, L2 being wound respectively in an aiding direction on a ferrite rod (not shown), and with corresponding first ends of the two coils L1, L2 being connected respectively to the first node 31 and the third node 36.

The first resonant circuit 30 is resonant at a first frequency $f_1$ for receiving electromagnetic radiation at the first frequency $f_1$; and the second resonant circuit 35 is resonant at a second frequency $f_2$ that is one-half the first frequency $f_1$ for transmitting electromagnetic radiation at the second frequency $f_2$. The first circuit 30 is coupled magnetically to the second circuit 35, as described above, to transfer energy to the second circuit 35 at the first frequency $f_1$ in response to receipt by the first circuit 30 of electromagnetic radiation at the first frequency $f_1$. The coupling transistor $Q_C$ is semiconductor switching device having gain for causing the second resonant circuit 35 to transmit electromagnetic radiation at the second frequency $f_2$ in response to the energy transferred from the first resonant circuit 30 at the first frequency $f_1$.

In other respects, the frequency divider of FIG. 3 is of like construction and operates in the same manner as the frequency divider of FIG. 1.

Referring to FIG. 4, an alternative preferred embodiment of a frequency divider according to the present invention includes a first resonant circuit 40 consisting of a capacitor C1 connected in parallel with an inductance coil L1 between a first node 41 and second node 42; a second resonant circuit 45 consisting of a varactor D2 connected in parallel with a second inductance coil L2 between the second node 42 and a third node 46; and a coupling npn transistor $Q_C$ having its emitter connected to the first node 41, its collector connected to the second node 42 and its base connected to the third node 46 to electrically connect the first resonant circuit 40 to the second resonant circuit 45. The first resonant circuit 40 is magnetically coupled to the second resonant circuit 45 by disposing the first coil L1 in a mutual inductive coupling relationship M to the second coil L2, with the two coils L1, L2 being wound respectively in an aiding direction on a ferrite rod (not shown), and with corresponding first ends of the two coils L1, L2 being connected respectively to the first node 41 and the third node 46.

The varactor D2 in the second circuit 45 is a variable reactance element in which the reactance varies with variations in energy transferred from the first circuit 40 for further causing the second circuit 45 to transmit electromagnetic radiation at the second frequency $f_2$ in response to the energy transferred from the first circuit 40 at the first frequency $f_1$.

In other respects, the frequency divider of FIG. 4 is of like construction and operates in the same manner as the frequency divider of FIG. 3.

Referring to FIG. 5, an alternative preferred embodiment of a frequency divider according to the present invention includes a first resonant circuit 50 consisting of a varactor D1 connected in parallel with an inductance coil L1 between a first node 51 and second node 52; a second resonant circuit 55 consisting of a varactor D2 connected in parallel with a second inductance coil L2 between the second node 52 and a third node 56; and a coupling npn transistor $Q_C$ having its emitter connected to the first node 51, its collector connected to the second node 52 and its base connected to the third node 56 to electrically connect the first resonant circuit 50 to the second resonant circuit 55. The first resonant circuit 50 is magnetically coupled to the second resonant circuit 55 by disposing the first coil L1 in a mutual inductive coupling relationship M to the second coil L2, with the two coils L1, L2 being wound respectively in an aiding direction on a ferrite rod (not shown), and with corresponding first ends of the two coils L1, L2 being connected respectively to the first node 51 and the third node 56.

The varactor D1 in the first circuit 50 is a variable reactance element in which the reactance varies with variations in energy received by the first circuit 50 for causing the second circuit 55 to vary in reactance due to mutual reactive coupling to further cause the second resonant circuit 55 to transmit electromagnetic radiation at the second frequency $f_2$ in response to the energy transferred from the first circuit 50 at the first frequency $f_1$.

In other respects, the frequency divider of FIG. 5 is of like construction and operates in the same manner as the frequency divider of FIG. 4.

Referring to FIG. 6, an alternative preferred embodiment of a frequency divider according to the present invention includes a first resonant circuit 60 consisting of a capacitor C1 connected in parallel with an inductance coil L1 between a first node 61 and second node 62; a second resonant circuit 65 consisting of a capacitor C2 connected in parallel with a second inductance coil L2 between the second node 62 and a third node 66; and a coupling npn transistor $Q_C$ having its emitter connected to the first node 61, its base connected to the second node 62 and its collector connected to the third node 66 to electrically connect the first resonant circuit 60 to the second resonant circuit 65. The first resonant circuit 60 is magnetically coupled to the second resonant circuit 65 by disposing the first coil L1 in a mutual inductive coupling relationship M to the second coil L2, with the two coils L1, L2 being wound respectively in an aiding direction on a ferrite rod (not shown), and with corresponding first ends of the two coils L1, L2 being connected respectively to the first node 61 and the third node 66.

The first resonant circuit 60 is resonant at a first frequency $f_1$ for receiving electromagnetic radiation at the first frequency $f_1$; and the second resonant circuit 65 is resonant at a second frequency $f_2$ that is one-half the first frequency $f_1$ for transmitting electromagnetic radiation at the second frequency $f_2$. The first circuit 60 is coupled magnetically to the second circuit 65, as described above, to transfer energy to the second circuit 65 at the first frequency $f_1$ in response to receipt by the first circuit 60 of electromagnetic radiation at the first frequency $f_1$. The coupling transistor $Q_C$ is semiconductor switching device having gain for causing the second resonant circuit 65 to transmit electromagnetic radiation at the second frequency $f_2$ in response to the energy transferred from the first resonant circuit 60 at the first frequency $f_1$.

In other respects, the frequency divider of FIG. 6 is of like construction and operates in the same manner as the frequency divider of FIG. 3.

Referring to FIG. 7, an alternative preferred embodiment of a frequency divider according to the present invention includes a first resonant circuit 70 consisting of a capacitor C1 connected in parallel with an inductance coil L1 between a first node 71 and second node 72; a second resonant circuit 75 consisting of a varactor D2 connected in parallel with a second inductance coil L2 between the second node 72 and a third node 76; and a coupling npn transistor $Q_C$ having its emitter connected to the first node 71, its base connected to the second node 72 and its collector connected to the third node 76 to electrically connect the first resonant circuit 70 to the second resonant circuit 75. The first resonant circuit 70 is magnetically coupled to the second resonant circuit 75 by disposing the first coil L1 in a mutual inductive coupling relationship M to the second coil L2, with the two coils L1, L2 being wound respectively in an aiding direction on a ferrite rod (not shown), and with corresponding first ends of the two coils L1, L2 being connected respectively to the first node 71 and the third node 76.

The varactor D2 in the second circuit 75 is a variable reactance element in which the reactance varies with variations in energy transferred from the first circuit 70 for further causing the second circuit 75 to transmit electromagnetic radiation at the second frequency $f_2$ in response to the energy transferred from the first circuit 70 at the first frequency $f_1$.

In other respects, the frequency divider of FIG. 7 is of like construction and operates in the same manner as the frequency divider of FIG. 6.

Referring to FIG. 8, an alternative preferred embodiment of a frequency divider according to the present invention includes a first resonant circuit 80 consisting of a capacitor C1 connected in parallel with an inductance coil L1 between a first node 81 and second node 82; a second resonant circuit 85 consisting of a varactor D2 connected in parallel with a second inductance coil L2 between the second node 82 and a third node 86; and a coupling npn transistor $Q_C$ having its collector connected to the first node 81, its base connected to the second node 82 and its emitter connected to the third node 86 to electrically connect the first resonant circuit 80 to the second resonant circuit 85. The first resonant circuit 80 is magnetically coupled to the second resonant circuit 85 by disposing the first coil L1 in a mutual inductive coupling relationship M to the second coil L2, with the two coils L1, L2 being wound respectively in an aiding direction on a ferrite rod (not shown), and with corresponding first ends of the two coils L1, L2 being connected respectively to the first node 81 and the third node 86.

In other respects, the frequency divider of FIG. 8 is of like construction and operates in the same manner as the frequency divider of FIG. 7.

Referring to FIG. 9, an alternative preferred embodiment of a frequency divider according to the present invention includes a first resonant circuit 90 consisting of a capacitor C1 connected in parallel with an inductance coil L1 between a first node 91 and second node 92; a second resonant circuit 95 consisting of a varactor D2 connected in parallel with a second inductance coil L2 between the second node 92 and a third node 96; and a coupling npn transistor $Q_C$ having its collector connected to the first node 91, its emitter connected to the second node 92 and its base connected to the third node 96 to electrically connect the first resonant circuit 90 to the second resonant circuit 95. The first resonant circuit 90 is magnetically coupled to the second resonant circuit 95 by disposing the first coil L1 in a mutual inductive coupling relationship M to the second coil L2, with the two coils L1, L2 being wound respectively in an aiding direction on a ferrite rod (not shown), and with corresponding first ends of the two coils L1, L2 both being connected to the second node 92.

In other respects, the frequency divider of FIG. 9 is of like construction and operates in the same manner as the frequency divider of FIG. 7.

Figure 10:
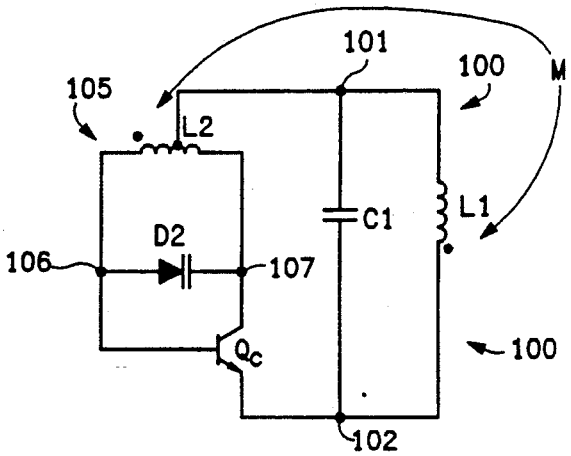
FIG. 10 is a diagram of still another alternative preferred embodiment of a frequency divider according to the present invention.

Referring to FIG. 10, an alternative preferred embodiment of a frequency divider according to the present invention includes a first resonant circuit 100 consisting of a capacitor C1 connected in parallel with an inductance coil L1 between a first node 101 and second node 102; a second resonant circuit 105 consisting of a varactor D2 connected in parallel with a second inductance coil L2 between a third node 106 and a fourth node 107; and a coupling npn transistor $Q_C$ having its emitter connected to the second node 102, its base connected to the third node 106 and its collector connected to the fourth node 107 to electrically connect the first resonant circuit 100 to the second resonant circuit 105. The first node 101 is also connected to a center tap within the coil L2. The first resonant circuit 100 is magnetically coupled to the second resonant circuit 105 by disposing the first coil L1 in a mutual inductive coupling relationship M to the second coil L2, with the two coils L1, L2 being wound respectively in an aiding direction on a ferrite rod (not shown), and with corresponding first ends of the two coils L1, L2 being connected respectively to the second node 102 and the third node 106.

In other respects, the frequency divider of FIG. 10 is of like construction and operates in the same manner as the frequency divider of FIG. 7.

In an alternative embodiment of the frequency divider shown in FIG. 10, a capacitance is substituted for the varactor D2 in the second resonant circuit 105. In such alternative embodiment, the coupling transistor $Q_C$ causes the second resonant circuit 105 to transmit electromagnetic radiation at the second frequency in response to the energy transferred from the first resonant circuit 100 at the first frequency.

Figure 11:
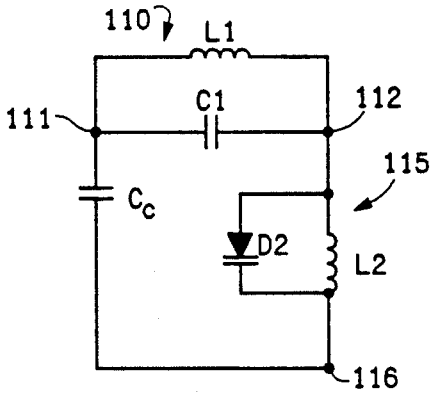
FIG. 11 is a diagram of a preferred embodiment of a frequency divider according to the aforementioned separate aspect of the present invention.

Referring to FIG. 11, a preferred embodiment of the frequency divider according to the separate aspect of the present invention includes a first resonant circuit 110 consisting of a capacitor C1 connected in parallel with an inductance coil L1 between a first node 111 and second node 112; a second resonant circuit 115 consisting of a varactor D2 connected in parallel with a second inductance coil L2 between the second node 112 and a third node 116; and a coupling capacitance $C_C$ connected between the first node 111 and the third node 116 to electrically connect the first resonant circuit 110 to the second resonant circuit 115. The first resonant circuit 110 is not magnetically coupled to the second resonant circuit 115.

The first resonant circuit 110 is resonant at a first frequency $f_1$ for receiving electromagnetic radiation at the first frequency $f_1$; and the second resonant circuit 115 is resonant at a second frequency $f_2$ that is one-half the first frequency $f_1$ for transmitting electromagnetic radiation at the second frequency $f_2$. The first circuit 110 is coupled electrically to the second circuit 115 by a passive circuit element, such as the coupling capacitance $C_C$, as described above, to transfer energy to the second circuit 115 at the first frequency $f_1$ in response to receipt by the first circuit 110 of electromagnetic radiation at the first frequency $f_1$. The varactor D2 in the second circuit 115 is a variable reactance element in which the reactance varies with variations in energy transferred from the first circuit 110 for causing the second circuit 115 to transmit electromagnetic radiation at the second frequency $f_2$ in response to the energy transferred from the first circuit 110 at the first frequency $f_1$.

Figure 12:
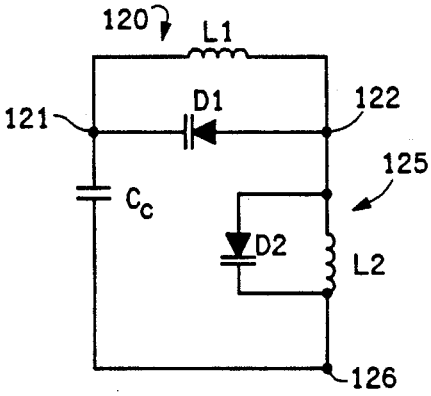
FIG. 12 is a diagram of an alternative preferred embodiment of a frequency divider according to the aforementioned separate aspect of the present invention.

Referring to FIG. 12, an alternative preferred embodiment of a frequency divider according to the separate aspect of the present invention includes a first resonant circuit 120 consisting of a varactor D1 connected in parallel with an inductance coil L1 between a first node 121 and second node 122; a second resonant circuit 125 consisting of a varactor D2 connected in parallel with a second inductance coil L2 between the second node 122 and a third node 126; and a coupling capacitance $C_C$ connected between the first node 121 and the third node 126 to electrically connect the first resonant circuit 120 to the second resonant circuit 125. The first resonant circuit 120 is not magnetically coupled to the second resonant circuit 125.

The varactor D1 in the first circuit 120 is a variable reactance element in which the reactance varies with variations in energy received by the first circuit 120 for causing the second circuit 125 to vary in reactance due to mutual reactive coupling to further cause the second resonant circuit 125 to transmit electromagnetic radiation at the second frequency $f_2$ in response to the energy transferred from the first circuit 120 at the first frequency $f_1$.

In other respects, the frequency divider of FIG. 12 is of like construction and operates in the same manner as the frequency divider of FIG. 11.

A varactor that has one or a plurality of parallel p-n junctions that exhibit a large and nonlinear change in capacitance with small levels of applied alternating voltage, such as a zener diode, is utilized for the voltage-responsive-variable-reactance elements in the embodiments described herein because of its low cost. In alternative embodiments some other device exhibiting the required large and nonlinear capacitance variation with applied alternating voltage, and having sufficiently low loss, and a high Q factor, could be substituted for a varactor. One such alternative variable-capacitance device consists of a lamination of an insulation material and a semiconductor material disposed between metal terminals, such that as a voltage applied across the terminals varies, a concentration of charge carriers in a region of the semiconductor material adjacent the insulation material varies to thereby vary the value of said capacitance. The semiconductor material includes a lightly doped epitaxial layer adjacent the insulation material and a heavily doped substrate between the lightly doped epitaxial layer and one of the metal terminals. Such a variable capacitance and a frequency divider including such a variable capacitance in a parallel resonant circuit with an inductance are the subject of a patent application Ser. No. 07/853,534 filed on Mar. 18, 1992 herewith by Ming Lian and Lincoln H. Charlot, Jr.

Figure 13:
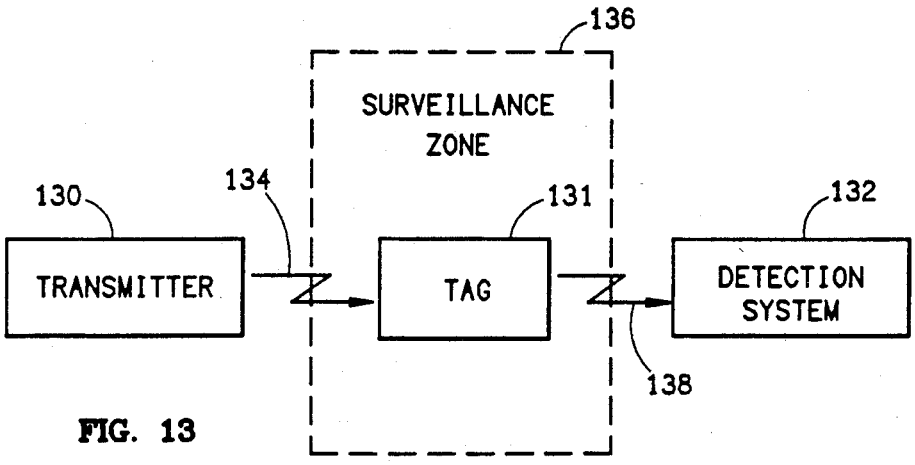
FIG. 13 is a diagram of a presence detection system according to the present invention, including a tag including a frequency divider according to the present invention.

A frequency divider according to the present invention is utilized in a preferred embodiment of a presence detection system according to the present invention, as shown in FIG. 13. Such system includes a transmitter 130, a tag 131 and a detection system 132.

The transmitter transmits an electromagnetic radiation signal 134 of a first predetermined frequency into a surveillance zone 136.

The tag 131 is attached to an article (not shown) to be detected within the surveillance zone 136. The tag 131 includes a batteryless, portable frequency divider in accordance with the present invention, such as the frequency divider described above with reference to FIG. 1.

The detection system 132 detects electromagnetic radiation 138 in the surveillance zone 136 at a second predetermined frequency that is one-half the first predetermined frequency, and thereby detects the presence of the tag in the surveillance zone 136.

The presence detection system utilizing a tag including the frequency divider of the present invention is used for various applications that take advantage of the size and efficiency of such frequency divider, including applications utilizing longer range tags, and applications utilizing small tags requiring only a short communication range.

In one example, small tags including the frequency divider of the present invention are subcutaneously implanted in animals and such animals are counted by the presence detection system.

In another example, small tags including the frequency divider of the present invention are implanted in non-metallic cannisters of explosives and such canisters are detected by the presence detection system.

In still another example, tags including embodiments of the frequency divider of the present invention that are relatively large in one dimension are implanted in non-metallic gun stocks and the guns are detected by the presence detection system.

To analyze the frequency divider of the present invention, reference is made to FIG. 1A, which is an equivalent circuit diagram of the frequency divider of FIG. 1. Voltage sources $V_{S1}$ and $V_{S2}$ are shown in the first and second resonant circuits 10 and 15 respectively to represent the magnetic induction resulting from external excitation; and the varactor D2 in the first resonant circuit 10 is represented by a zero-bias capacitance C2. The resistances R1 and R2 represent the overall loss associated with the respective first and second resonant circuits 10 and 15. The circulating currents $I_1$ and $I_2$ in the respective first and second resonant circuits 10 and 15 can be formulated as:

$$\begin{vmatrix} I_1 \\ I_2 \end{vmatrix} = A^{-1} \begin{vmatrix} V_{S1} \\ V_{S2} \end{vmatrix} \quad \text{(Eq. 1)}$$

$$A = \left( j\omega \begin{vmatrix} C_1 + C_C & C_C \\ C_C & C_2 + C_C \end{vmatrix}^{-1} \right) - j\omega \begin{vmatrix} L_1 & M \\ M & L_2 \end{vmatrix} - \begin{vmatrix} R_1 & 0 \\ 0 & R_2 \end{vmatrix} \quad \text{(Eq. 2)}$$

$$M = K\sqrt{L_1 L_2} \quad \text{(Eq. 3)}$$

where A is the impedance matrix, M is the mutual inductance between L1 and L2 and K is the mutual coupling coefficient of L1 and L2.

At the resonant frequencies, the impedance matrix A reaches its minimum and the circulating currents reach their maximum. In the case of zero electrical coupling ($C_C=0$), the two resonant frequencies can be expressed explicitly as a function of the magnetic coupling coefficient "K" and the other circuit parameters, as follows:

$$\omega_1^2 = \frac{L_1C_1 + \sqrt{(L_1C_1 + L_2C_2)^2 - 4C_1C_2(L_1L_2 - K^2L_1L_2)^2}}{2C_1C_2(L_1L_2 - K^2L_1L_2)} \quad \text{(Eq. 4)}$$

-continued $$\omega_2^2 = \frac{L_1C_1 - \sqrt{(L_1C_1 + L_2C_2)^2 - 4C_1C_2(L_1L_2 - K^2L_1L_2)^2}}{2C_1C_2(L_1L_2 - K^2L_1L_2)} \quad \text{(Eq. 5)}$$

Since the first frequency $\omega_1$ of the first resonant circuit 10 must be twice of the resonant frequency $\omega_2$ of the second resonant circuit 15, as the magnetic coupling coefficient K increases, the value of the inductance L1 increases and the value of the inductance L2 decreases because of the increased coupled reactance due to the interaction between the two coils until the values of L1 and L2 become identical at K=0.6. Thus, when there is no electrical coupling between the first resonant circuit 10 and the second resonant circuit 15, frequency division can not occur when the magnetic coupling coefficient K is greater than 0.6.

Figure 14:
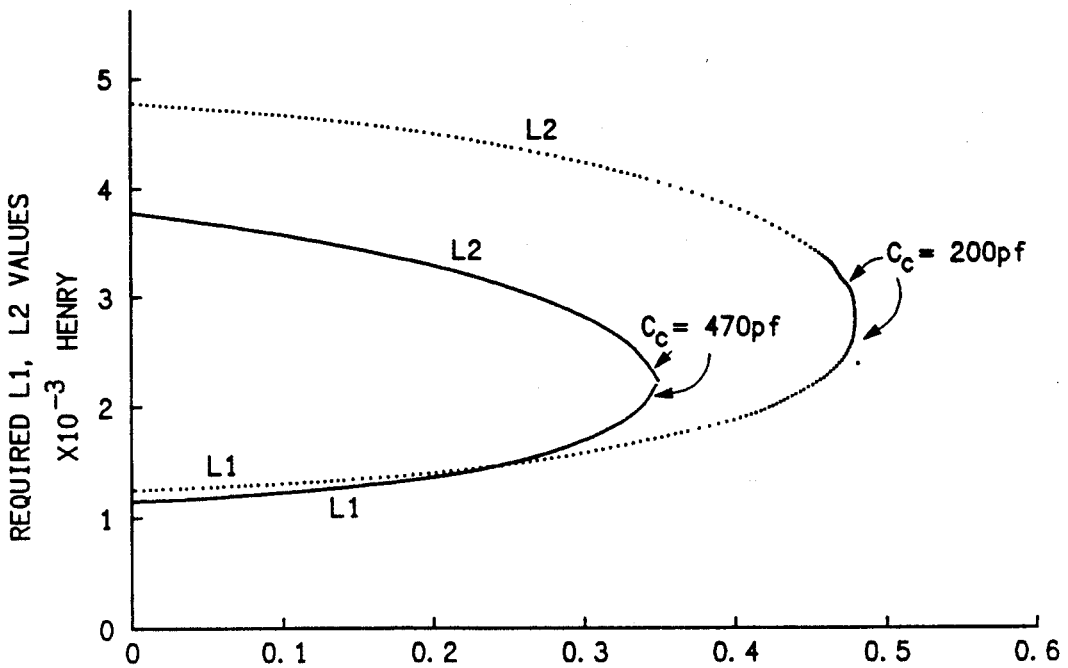
FIG. 14 is a graph showing the variable relationship between the values of the inductance coils and the mutual coupling coefficient K for the equivalent circuit of FIG. 1A for different exemplary values of the coupling capacitance $C_C$.

When there is electrical coupling between the first resonant circuit 10 and the second resonant circuit 15, as represented by the coupling capacitance $C_C$ having a finite value, the relationship between L1, L2 as a function of K becomes complicated and cannot be easily expressed in simple, explicit equations, such as Equations 4 and 5. However, with the help of computer-aided numerical analysis, the required L1 and L2 values can be calculated at different mutual coupling coefficient K values as shown in FIG. 14 for $C_C$=200 pF and 470 pF. Referring to FIG. 14, it is seen that the values of L1 and L2 approach each other and finally become identical as K increases. Frequency division cannot occur when K is greater than 0.48 and 0.35 for $C_C$=200 pF and 470 pF respectively.

Figure 15:
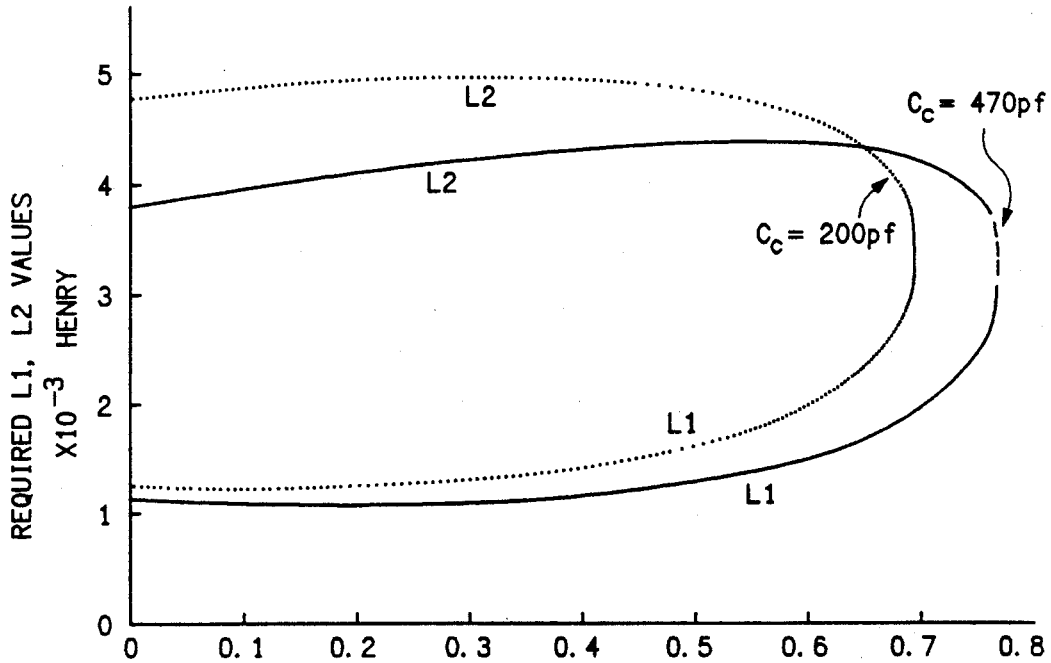
FIG. 15 is a graph showing the variable relationship between the values of the inductance coils and the mutual coupling coefficient K for the equivalent circuit of FIG. 1A with the polarity of the coil L1 being reversed from as shown therein, for different exemplary values of the coupling capacitance $C_C$.

FIG. 15 shows the variable relationship between the values L1 and L2 of the inductance coils and the mutual coupling coefficient K for the equivalent circuit of FIG. 1A when the polarity of the coil L1 is reversed from as shown therein, for coupling capacitance $C_C$ values of 200 pF and 470 pF. In such a case, the maximum allowable K increases to 0.7 and 0.77 respectively for $C_C$=200 pF and 470 pF. It is always the case that when the mutual coupling coefficient K reaches its extreme, the required L1 and L2 values become identical and the circuit becomes untunable and unstable as a frequency divider.

The frequency divider requires a minimum field intensity excitation to initiate frequency division. This parameter is referred as the turn on field intensity. FIG. 16 shows the variable relationship between the turn-on field intensity and the mutual coupling coefficient K for the frequency divider of FIG. 1 for coupling capacitance $C_C$ values of zero, 200 pF and 470 pF. It is seen that the optimum coupling decreases with increasing electrical coupling.

FIG. 17 shows the variable relationship between the magnitude of the electromagnetic radiation at the second frequency transmitted by the second resonant circuit 15 of the frequency divider of FIG. 1 and the mutual coupling coefficient K for coupling capacitance $C_C$ values of zero, 200 pF and 470 pF. It is seen that the magnitude of the signal transmitted by the second resonant circuit 15 at the second resonant frequency $f_2$ increases with increasing degree of magnetic or electrical coupling. Therefore, the magnetic and electrical coupling must be adjusted for best overall effects.

We claim:

1. A batteryless, portable, frequency divider, comprising a first resonant circuit that is resonant at a first frequency for receiving electromagnetic radiation at the first frequency; and a second resonant circuit that is resonant at a second frequency that is one-half the first frequency for transmitting electromagnetic radiation at the second frequency; and circuit element means electrically connecting the first resonant circuit to the second resonant circuit;

wherein the first resonant circuit is coupled magnetically to the second resonant circuit to transfer energy to the second resonant circuit at the first frequency in response to receipt by the first resonant circuit of electromagnetic radiation at the first frequency; and wherein at least one of the first resonant circuit, the second resonant circuit and the circuit element means includes means for causing the second resonant circuit to transmit electromagnetic radiation at the second frequency in response to the energy transferred from the first resonant circuit at the first frequency.

2. A frequency divider according to claim 1, wherein the second resonant circuit includes a variable reactance element in which the reactance varies with variations in energy transferred from the first resonant circuit for causing the second resonant circuit to transmit electromagnetic radiation at the second frequency in response to the energy transferred from the first resonant circuit at the first frequency.

3. A frequency divider according to claim 2, wherein the circuit element means includes a semiconductor switching device having gain for causing the second resonant circuit to transmit electromagnetic radiation at the second frequency in response to the energy transferred from the first resonant circuit at the first frequency.

4. A frequency divider according to claim 1, wherein the first resonant circuit includes a variable reactance element in which the reactance varies with variations in energy received by the first resonant circuit for causing the second resonant circuit to vary in reactance due to mutual reactive coupling to cause the second resonant circuit to transmit electromagnetic radiation at the second frequency in response to the energy transferred from the first resonant circuit at the first frequency.

5. A frequency divider according to claim 4, wherein the circuit element means includes a semiconductor switching device having gain for causing the second resonant circuit to transmit electromagnetic radiation at the second frequency in response to the energy transferred from the first resonant circuit at the first frequency.

6. A frequency divider according to claim 1, wherein the circuit element means includes a variable reactance element in which the reactance varies with variations in energy received by the first resonant circuit for causing the second resonant circuit to transmit electromagnetic radiation at the second frequency in response to the energy transferred from the first resonant circuit at the first frequency.

7. A frequency divider according to claim 1, wherein the circuit element means includes a semiconductor switching device having gain for causing the second resonant circuit to transmit electromagnetic radiation at the second frequency in response to the energy transferred from the first resonant circuit at the first frequency.

8. A tag for use in a presence detection system, comprising a frequency divider; and means for fastening the frequency divider to an article to be detected by the presence detection system;

wherein the frequency divider comprises a first resonant circuit that is resonant at a first frequency for receiving electromagnetic radiation at the first frequency; and a second resonant circuit that is resonant at a second frequency that is one-half the first frequency for transmitting electromagnetic radiation at the second frequency; and circuit element means electrically connecting the first resonant circuit to the second resonant circuit;

wherein the first resonant circuit is coupled magnetically to the second resonant circuit to transfer energy to the second resonant circuit at the first frequency in response to receipt by the first resonant circuit of electromagnetic radiation at the first frequency; and wherein at least one of the first resonant circuit, the second resonant circuit and the circuit element means includes means for causing the second resonant circuit to transmit electromagnetic radiation at the second frequency in response to the energy transferred from the first resonant circuit at the first frequency.

9. A tag according to claim 8, wherein the second resonant circuit includes a variable reactance element in which the reactance varies with variations in energy transferred from the first resonant circuit for causing the second resonant circuit to transmit electromagnetic radiation at the second frequency in response to the energy transferred from the first resonant circuit at the first frequency.

10. A tag according to claim 8, wherein the first resonant circuit includes a variable reactance element in which the reactance varies with variations in energy received by the first resonant circuit for causing the second resonant circuit to vary in reactance due to mutual reactive coupling to cause the second resonant circuit to transmit electromagnetic radiation at the second frequency in response to the energy transferred from the first resonant circuit at the first frequency.

11. A tag according to claim 8, wherein the circuit element means includes a variable reactance element in which the reactance varies with variations in energy received by the first resonant circuit for causing the second resonant circuit to transmit electromagnetic radiation at the second frequency in response to the energy transferred from the first resonant circuit at the first frequency.

12. A tag according to claim 8, wherein the circuit element means includes a semiconductor switching device having gain for causing the second resonant circuit to transmit electromagnetic radiation at the second frequency in response to the energy transferred from the first resonant circuit at the first frequency.

13. A presence detection system, comprising means for transmitting an electromagnetic radiation signal at a first frequency into a surveillance zone;

a tag for attachment to an article to be detected within the surveillance zone, comprising a frequency divider and means for fastening the frequency divider to an article to be detected by the presence detection system; wherein the frequency divider comprises a first resonant circuit that is resonant at a first frequency for receiving electromagnetic radiation at the first frequency; and a second resonant circuit that is resonant at a second frequency that is one-half the first frequency for transmitting electromagnetic radiation at the second frequency; and circuit element means electrically connecting the first resonant circuit to the second resonant circuit;

wherein the first resonant circuit is coupled magnetically to the second resonant circuit to transfer energy to the second resonant circuit at the first frequency in response to receipt by the first resonant circuit of electromagnetic radiation at the first frequency; and wherein at least one of the first resonant circuit, the second resonant circuit and the circuit element means includes means for causing the second resonant circuit to transmit electromagnetic radiation at the second frequency in response to the energy transferred from the first resonant circuit at the first frequency; and means for detecting electromagnetic radiation at the second frequency in the surveillance zone.

14. A presence detection system according to claim 13, wherein the second resonant circuit includes a variable reactance element in which the reactance varies with variations in energy transferred from the first resonant circuit for causing the second resonant circuit to transmit electromagnetic radiation at the second frequency in response to the energy transferred from the first resonant circuit at the first frequency.

15. A presence detection system according to claim 13, wherein the first resonant circuit includes a variable reactance element in which the reactance varies with variations in energy received by the first resonant circuit for causing the second resonant circuit to vary in reactance due to mutual reactive coupling to cause the second resonant circuit to transmit electromagnetic radiation at the second frequency in response to the energy transferred from the first resonant circuit at the first frequency.

16. A presence detection system according to claim 13, wherein the circuit element means includes a variable reactance element in which the reactance varies with variations in energy received by the first resonant circuit for causing the second resonant circuit to transmit electromagnetic radiation at the second frequency in response to the energy transferred from the first resonant circuit at the first frequency.

17. A presence detection system according to claim 13, wherein the circuit element means includes a semiconductor switching device having gain for causing the second resonant circuit to transmit electromagnetic radiation at the second frequency in response to the energy transferred from the first resonant circuit at the first frequency.

18. A batteryless, portable, frequency divider, comprising a first resonant circuit that is resonant at a first frequency for receiving electromagnetic radiation at the first frequency; and a second resonant circuit that is resonant at a second frequency that is one-half the first frequency for transmitting electromagnetic radiation at the second frequency; and passive circuit element means electrically connecting the first resonant circuit to the second resonant circuit to transfer energy to the second resonant circuit at the first frequency in response to receipt by the first resonant circuit of electromagnetic radiation at the first frequency;

wherein the first resonant circuit is not coupled magnetically to the second resonant circuit; and wherein at least one of the first resonant circuit and the second resonant circuit includes a variable reactance element in which the reactance varies with variations in energy received by the first resonant circuit for causing the second resonant circuit to transmit electromagnetic radiation at the second frequency in response to the energy transferred from the first resonant circuit at the first frequency.

19. A frequency divider according to claim 18, wherein the passive circuit element means includes a capacitance.

20. A tag for use in a presence detection system, comprising a frequency divider; and means for fastening the frequency divider to an article to be detected by the presence detection system;

wherein the frequency divider comprises a first resonant circuit that is resonant at a first frequency for receiving electromagnetic radiation at the first frequency; and a second resonant circuit that is resonant at a second frequency that is one-half the first frequency for transmitting electromagnetic radiation at the second frequency; and passive circuit element means electrically connecting the first resonant circuit to the second resonant circuit to transfer energy to the second resonant circuit at the first frequency in response to receipt by the first resonant circuit of electromagnetic radiation at the first frequency;

wherein the first resonant circuit is not coupled magnetically to the second resonant circuit; and wherein at least one of the first resonant circuit and the second resonant circuit includes a variable reactance element in which the reactance varies with variations in energy received by the first resonant circuit for causing the second resonant circuit to transmit electromagnetic radiation at the second frequency in response to the energy transferred from the first resonant circuit at the first frequency.

21. A presence detection system, comprising means for transmitting an electromagnetic radiation signal at a first frequency into a surveillance zone;

a tag for attachment to an article to be detected within the surveillance zone, comprising a frequency divider and means for fastening the frequency divider to an article to be detected by the presence detection system; wherein the frequency divider comprises a first resonant circuit that is resonant at a first frequency for receiving electromagnetic radiation at the first frequency; and a second resonant circuit that is resonant at a second frequency that is one-half the first frequency for transmitting electromagnetic radiation at the second frequency; and passive circuit element means electrically connecting the first resonant circuit to the second resonant circuit to transfer energy to the second resonant circuit at the first frequency in response to receipt by the first resonant circuit of electromagnetic radiation at the first frequency;

wherein the first resonant circuit is not coupled magnetically to the second resonant circuit; and wherein at least one of the first resonant circuit and the second resonant circuit includes a variable reactance element in which the reactance varies with variations in energy received by the first resonant circuit for causing the second resonant circuit to transmit electromagnetic radiation at the second frequency in response to the energy transferred from the first resonant circuit at the first frequency; and means for detecting electromagnetic radiation at the second frequency in the surveillance zone.

* * * * *